United States Patent [19]

Mabboux

[11] Patent Number: 5,005,301

[45] Date of Patent: Apr. 9, 1991

[54] SKI BOOT

[75] Inventor: Michel Mabboux, Seynod, France

[73] Assignee: Salomon S. A., Annecy Cedex, France

[21] Appl. No.: 497,320

[22] Filed: Mar. 22, 1990

[30] Foreign Application Priority Data

Mar. 23, 1989 [FR] France ..... 89 04200

[51] Int. Cl.[5] ..... A43B 5/04

[52] U.S. Cl. ..... 36/117; 36/119

[58] Field of Search ..... 36/117-121; 280/618, 620

[56] References Cited

U.S. PATENT DOCUMENTS 4,765,070 8/1988 Chemello et al. ..... 36/117

FOREIGN PATENT DOCUMENTS 0307652 3/1989 European Pat. Off. ..... 36/117

2316212 10/1973 Fed. Rep. of Germany ..... 36/117

*Primary Examiner*—Paul T. Sewell

*Assistant Examiner*—Ted Kavanaugh

*Attorney, Agent, or Firm*—Pollock, Vande Sande & Priddy

[57] ABSTRACT

Alpine ski boot comprising a shell base (8) equipped with a walking sole (9) and a shaft (10), a rigid inner sole (11) which is movable vertically in relation to the bottom (12) of the shell base (8) and elements for closing said boot and for maintaining the user's foot in position. The boot comprises a device (13, 13') for transmitting pressures exerted by the foot, from the interior to the exterior of the boot, the device comprising the inner sole (11) hinged (14) to the bottom (12) of the shell base (8), and a support element (17) which is movable in translation across the walking sole (9) and which is subjected to the pressures transmitted by the inner sole (11) toward the top (7) of the ski (2).

17 Claims, 6 Drawing Sheets

FIG: 6
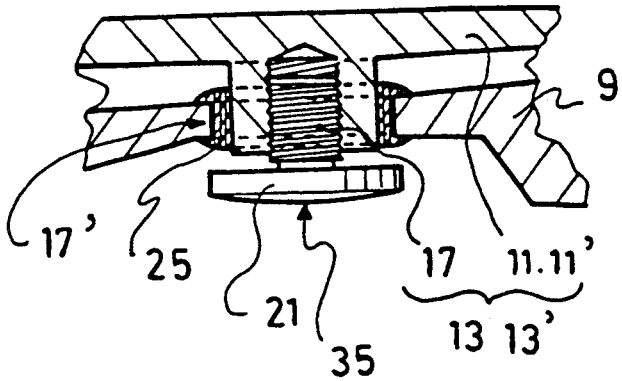
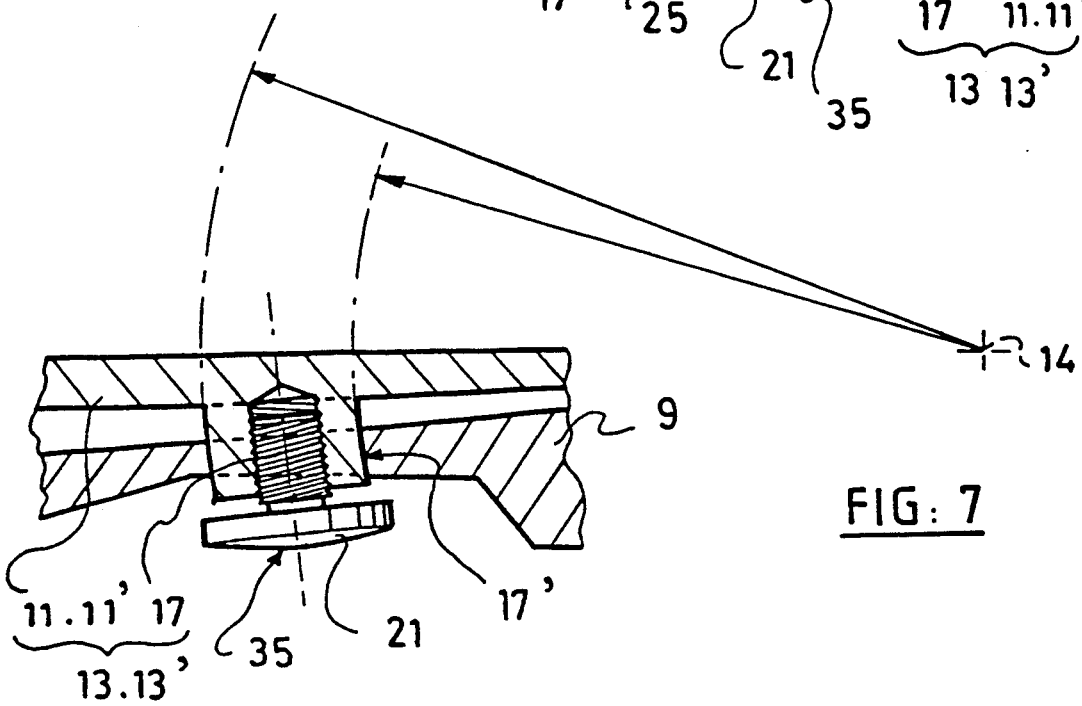
FIG: 7
FIG: 8
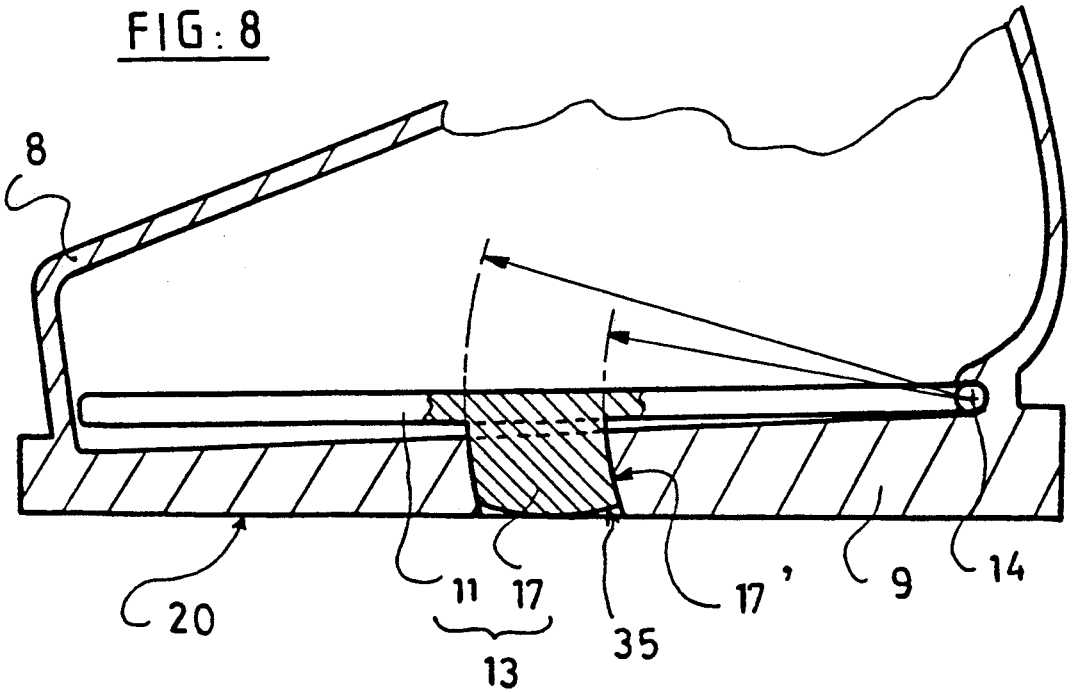

SKI BOOT

FIELD OF THE INVENTION

The present invention relates to Alpine ski boots and their cooperation with the ski when they are held in place on the latter by bindings. In particular, it relates to a device providing for the transmission of the pressures the foot exerts inside the boot onto the top of the ski during skiing.

BACKGROUND OF THE INVENTION

Ski boots fitted with means for cooperation with the top of the ski, and indeed for being secured onto the latter when the bindings are closed over the soles of said boots, are well known. The boot described in French Patent N° 2 407 681 may be mentioned as an example of precisely this type; in this kind of construction, it is basically the position maintenance of the foot which is sought, simultaneously with the closing of the rear binding over the heel of the boot. For this purpose, a movable part is provided which protrudes beneath the sole in the rest position and retracts into said sole under the locking tension exerted by the binding. This movable part is arranged so as to act in coordination with the binding support plate, i.e., in the heel area, and actuates a foot-positioning device.

In the case of the boot disclosed in U.S. Pat. No. N° 3,893,683 it is the unlocking of the boot from the ski when the skier executes pronounced forward bends which is sought. For this purpose, the shaft of the boot has a lower extension piece which come into contact with the top of the ski in the rest position and which projects outward as soon as said shaft pivots forward. Since the shaft forms a lever, it is necessary only that it pivot to a certain degree in order to cause the heel of the boot to be raised off the ski, and thus, the release of said boot by opening the binding.

SUMMARY OF THE INVENTION

The boot according to the invention is intended to modify and/or control the behavior of the skis during skiing, because of a device which transmits foot pressures onto the top of the ski within a central area located approximately between the bindings which fasten the boot onto said ski.

According to the invention, the ski boot, which is composed of a shell base fitted with a walking sole and surmounted by a shaft, a rigid inner sole which can be moved vertically in relation to the bottom of the shell base, and means for closing and position maintenance on the foot comprises a device for transmitting foot pressures from the interior to the exterior of the boot, said device comprising, first, the inner sole which is hinged to only one of its ends in relation to the bottom of the shell base, and second, a support element, movable in substantially vertical translational motion and mounted at the approximate mid-point of the length of the walking sole of the boot, said support element cooperating with the bottom of the inner sole and extending from a point on the latter toward the exterior of the boot through an opening cut in the bottom of the boot shell, so as to cooperate with a support area located on the top of the ski.

Thus, by means of the support element, this foot-pressure-transmission device is designed to cooperate with the top of the ski, approximately in the median zone of the "runner" of the ski, located between the bindings which hold the boot in place on the ski. For this purpose, the support element comes directly into contact with the top of the ski, as required, by means of a block located on the latter, and, in particular, it projects outward sufficiently to be at least partially pushed back into the interior of the boot when this latter is set down and held on the ski by bindings. Thus, by being pushed back into the interior of the boot, the support element raises by a certain amount the non-hinged end of the inner sole in relation to the bottom of the shell base, thereby automatically placing the seating of the foot in the boot in skiing position. From this position, it is necessary only that a strong pressure be exerted by the skier's foot on the raised end of the inner sole to ensure that, by a procedure that reverses the positioning of the boot on the ski, the support element is pushed back and pressed against the top of the ski, thereby causing the latter to bend between the bindings. As can be seen, the transmission device thus makes it possible to control the behavior of the ski as it bends when supporting stresses are applied to the front or rear, by centralizing in particular the pressures between the bindings.

Furthermore, when the skier totally eliminates the load he exerts, for example as a result of a flexion-extension, flexion-rebound, etc., the device acts as a shock absorber for the ski when the latter undergoes a spring-back, counter-flexion movement, i.e., in the direction of the camber. In fact, in order to reach a counter-flexion position, the ski must then push the support element and the sole back up, beyond the initial skiing position. During this counter-flexion, the foot, housed in the boot, counteracts, by virtue of its volume and composition, the movement of re-entry of the support element into the shell, thus limiting the amplitude of the counter-flection. The device therefore makes it possible to control, in addition, the behavior of the ski in a counter-flexed position, by acting to partially counteract its deformation in the direction of its camber.

Furthermore, according to one variant of the device, at least either the movable sole or the support element is fitted with a stopping means limiting its potential upward movement toward the skier's foot, beyond a predetermined limit such as, for example, that corresponding to the optimum foot-clamping position. Thus, when the ski loses its tension in the counter-flexed position, the device follows its movement only up to the point at which it is stopped by the stopping means, before firmly opposing any greater amplitude of deformation of said ski. The device thus makes it possible also to control the behavior of the ski when the skier's weight is removed, without intensifying the of the foot in the boot.

BRIEF DESCRIPTION OF THE DRAWINGS

The invention will be better understood by referring to the following description of the invention with reference to the attached drawings which illustrate several embodiments of the invention by way of example.

FIG. 3 shows the operation of the device when the ski is counter-flexed, while FIGS. 3*a* and 3*b* each show a specific arrangement of the support element, which is limited in its upward motion.

FIGS. 6, 7, and 8 shows construction details of the pressure-transmission device.

DESCRIPTION OF THE PREFERRED EMBODIMENTS

Figure 1:
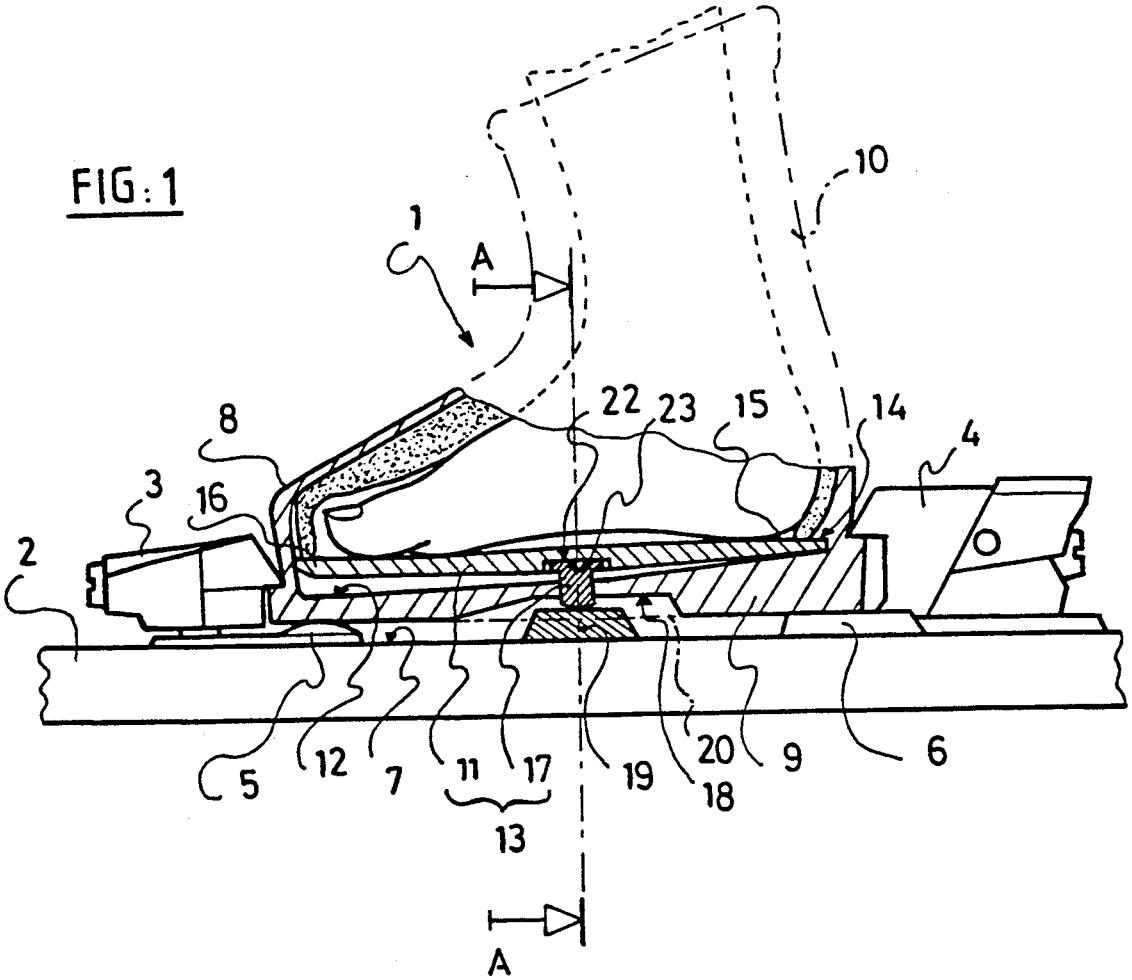
FIGS. 1 to 3*b* are longitudinal cross-section views of a ski boot comprising a device for the transmission of foot pressure exerted within the boot and on the top of the ski in accordance with the invention. In this first embodiment, the device is so arranged as to function more especially when forward foot pressures are exerted on the inner sole, as illustrated in FIG. 2 in particular.
Figure 2:
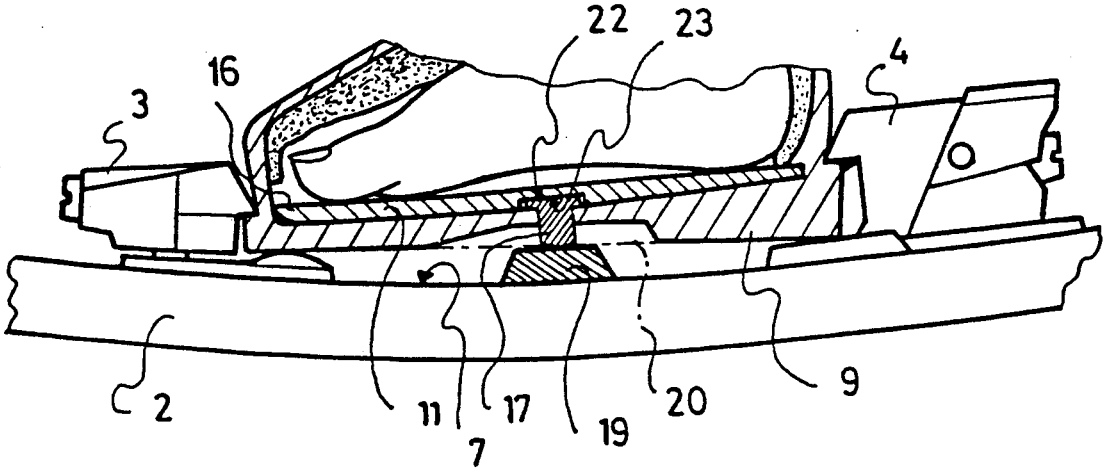
Figure 3:
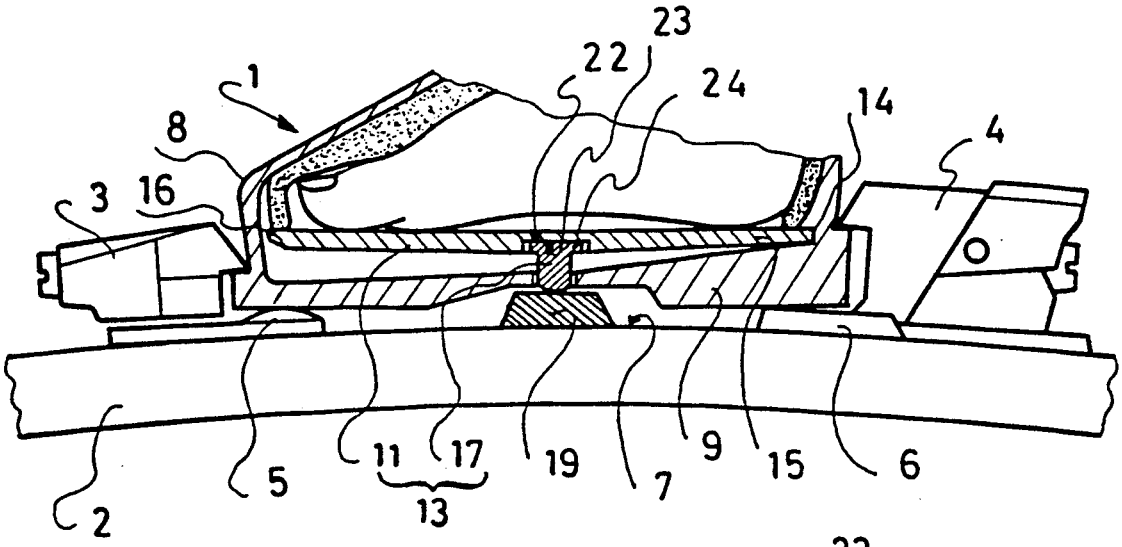

As seen in FIGS. 1, 2, and 3, the ski boot 1 is shown fastened in position on a ski 2 by means of forward and rear bindings 3,4. In this position, the boot 1 rests on forward and rear support plates 5 and 6, according to recommended customary mounting, and its sole 9 is, therefore, separated from the top 7 of the ski 2 by a short distance. The boot is composed of a shell base 8 equipped with a walking sole 9, a shaft 10, an inner sole 11 which is rigid and movable vertically in relation to the bottom 12 of the shell base, and conventional means of closing and of maintenance on the foot, consisting of laces, hooks, buckles, etc. (not shown). According to the invention, the boot is fitted with a device 13 for the transmission of foot pressures from the interior to the exterior of the boot. This device 13 comprises the inner sole 11, mounted by means of a hinge 14 at its rear extremity 15 onto the bottom 12 of the shell base 8 against which it comes to rest, and a support element 17 which is movable in translation motion and installed substantially at the mid-point between the tip and the heel of the walking sole. This support element 17 extends from the inner sole 11 to the outside of the walking sole 9 of the boot, from which it projects. In this embodiment, the support element 17 has a height such that it projects outward only within the height of recess 18 of the walking sole 9. Thus, it does not contact the ground during walking and can rest for support on the top of the ski 2 only through the intermediary of a block 19 mounted on the ski, and then only when the boot is in its fastened position on the ski. According to one feature of the invention, the height of the block 19, added to that of the support element 17 up to the inner sole 11, is greater than the height between the bottom 12 of the shell base 8 and the top 7 of the ski 2. In this way, when the boot 1 is held in position and pressed down against the ski 2 by the bindings 3, 4, as illustrated in FIG. 1, the support element 17 is pushed back within the boot by an amount equal to this difference in height, and it raises the inner sole 11 proportionately, determining at the same time the support of the foot in the boot in the skiing position. Furthermore, the result of this construction is that the skier can use these ski boots for walking without subjecting his feet to compression at each step, since the support element 17 is set back from the plane 20 of the walking surface of the sole 9, even when the inner sole 11 comes to rest on the bottom 12 of the shell base (FIG. 2).

When, beginning in the initial fastened position of the boot 1 on the ski 2, shown in FIG. 1, the skier shifts his weight onto the front end 16 of the inner sole 11, as shown in FIG. 2, said inner sole 11 pivots on its hinge 14 and pushes the support element 17 back toward the top of the ski 2 and against the block 19, exerting a stress on this latter which causes it to bend between the bindings 3, 4.

Figure 3A:
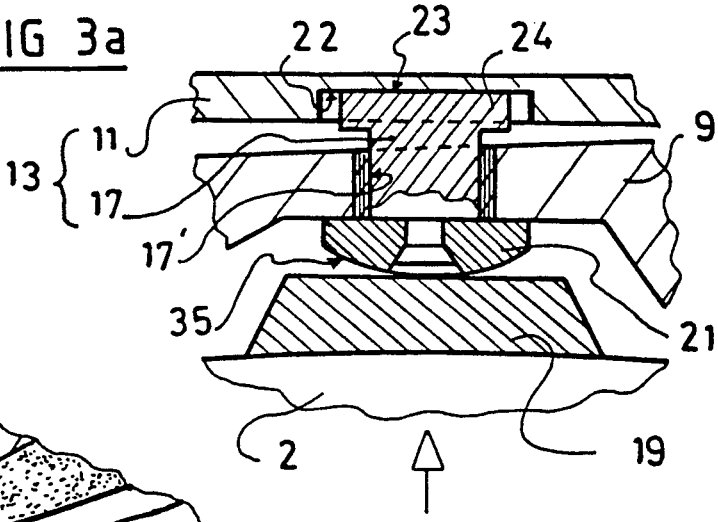
Figure 4:
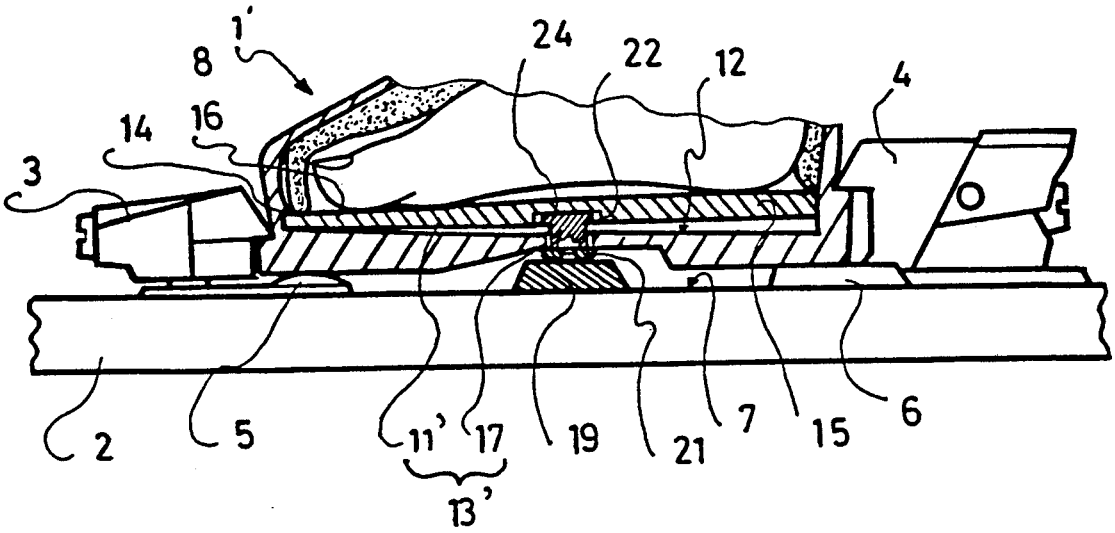
FIGS. 4 and 5 show a ski boot fitted with a device according to the invention and arranged so as to operate more especially when rearward pressures are exerted by the foot on the inner sole, and which comprises a stopping means which restricts the support element in its upward motion.

Yet again, as shown in FIG. 3, when the ski loses tension in a counter-flexed position when the skier's weight is reduced, as a result, for example, of a flexion-rebound, the transmission device 13 controls the tension-reducing movement of the ski by slowing it considerably. Indeed, the support element 17 is, in particular, pushed back to the inside of the boot 1 by means of the block 19 and raises the inner sole 11 upward beyond the initial skiing position, by causing the compression of the skier's foot to an extreme degree, until the block 17 comes into contact with the walking sole 9 of the boot. The transmission device 13 thus makes it possible to control the behavior of the ski in the counter-flexed position. As shown schematically in FIG. 3*a*, the support element 17 may advantageously be fitted with a high stop means 21 composed, for example, of a washer whose outer circumference is greater than that of the guide 17' of the support element 17 within the sole 9. Thus, the ski 2 is halted in its counter-flexion movement as soon as the stop mean is pressed against the sole 9. This high stop means 21 will preferably be placed on the support element 17 at a predetermined height corresponding to the optimum clamping of the foot in the boot in the initial skiing position, as illustrated in FIG. 4. In this embodiment, the eventual counter-flexion movement of the ski 2 is thus rendered impossible, at least between the two bindings 3 and 4, and the clamping of the foot in the boot is not intensified.

Figure 3B:
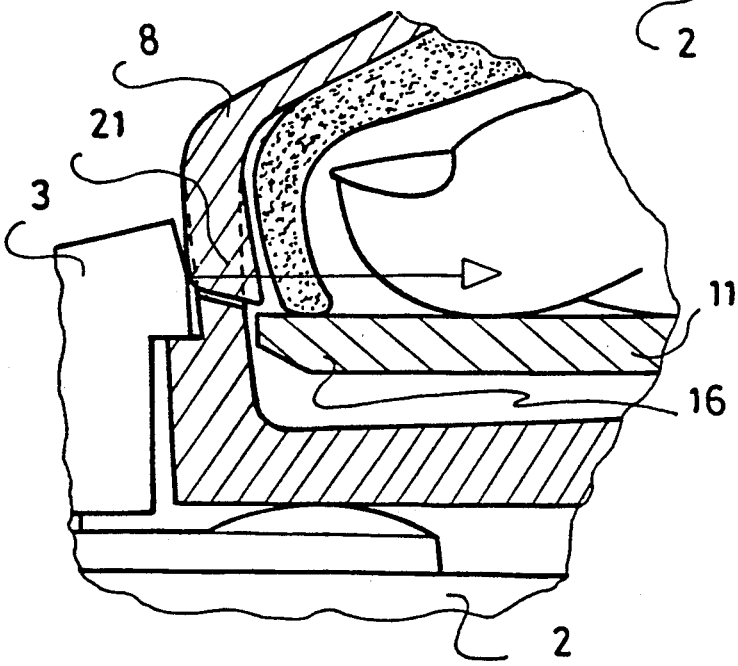

As also shown in FIG. 3*b*, a high stop means 21 may be provided between the shell base 8 and the inner sole 11 to prevent the latter from compressing the foot during counter-flexion of the foot. In the example shown, the means 21 is an elastic tongue arranged in the wall of the shell base 8. When the boot is not inserted in the front binding 3, this tongue is in a raised position on the outside of the shell base 8, and is pushed toward the interior of the latter by said binding 3, when said binding 3 holds the front part of the sole 9 in place on the ski; the tongue, thus positioned, protrudes inside the shell base 8 and above the tip 16 of the movable sole 11, thereby constituting the high stop means 21 of the latter.

Figure 5:
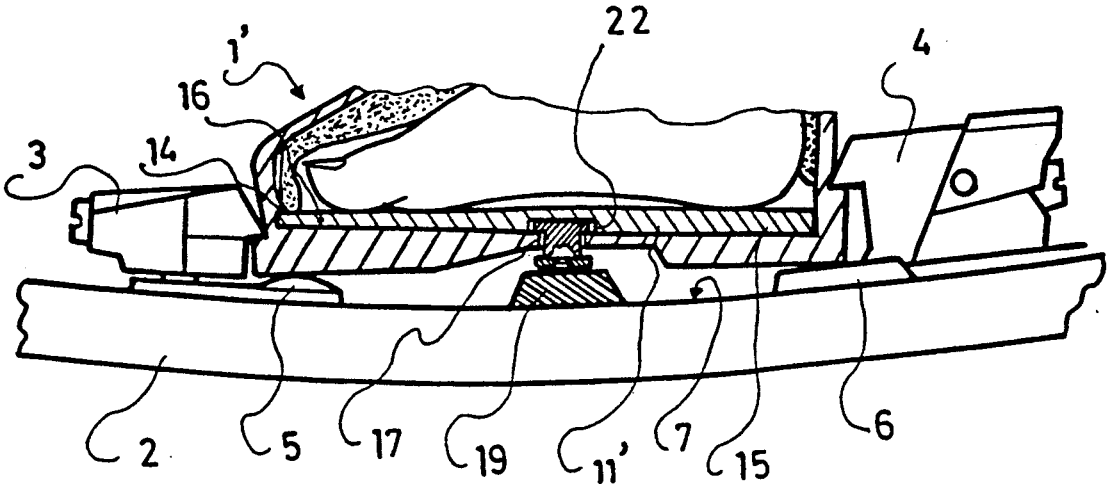

In FIGS. 4 and 5, the transmission device 13' is equivalent to device 13 described previously with reference to FIGS. 1 to 3, and is distinguishable from it, apart from the construction detail of the support element 17, solely by the fact that the front end 16 of the inner sole 11' is hinged 14 onto the bottom 12 of the shell base 8. This arrangement of device 13' is designed simply to favor the transmission of the pressures of the rear of the foot onto the inner sole 11', in contradistinction to the device 13 of boot 1 which transmitted the front pressures. As shown in FIG. 5, it is therefore the lowering of the rear extremity 15 of the inner sole 11' which occurs during a relatively sizable increase in the pressure exerted by the skier's heel on the latter; in consequence of the lowering of the end 15 of the sole 11', the support element 17 pushes the block back and causes the ski 2 to bend between bindings 3 and 4.

In the embodiments of the invention which have just been described with reference to FIGS. 1 to 5, it was specified that the transmission devices 13, 13' could, or could not, comprise high stop means 21 mounted on the support element 17 or on the shell base. As has been seen, these stop means 21 are fixed and thus determine the limit of possible upward motion of the inner sole in a predetermined and unchanging manner. However, still according to the invention, adjustable stop means 21 may also be provided to allow very precise adjustment of the stable position of the foot in the boot in the initial skiing position, whatever the distance of separation of the walking sole of said boot from the top of the ski 2 and/or of the thickness of the block fastened on the latter.

Thus, in the embodiment illustrated in FIGS. 6 and 7, the support element 17 is provided with a high stop 21 constituted by a threaded part comprising a head designed to be positioned so as to come to rest for support downward on the top 7 of the ski 2 or on the block, as well as upward against the sole 9 around the guide 17'. Since this threaded part is screwed into a corresponding hole provided in the support element 17, it then becomes possible to change the height of the latter in relation to the inner sole 11, 11', changing accordingly the amplitude of upward movement of the inner sole 11, 11', and, therefore, adjusting the seating position of the foot in the boot in the initial skiing position.

Other constructional details of the transmission device 13, 13' may also be used without departing from the scope of the invention. In particular, the support element 17 was previously described as extending from the inner sole 11, 11' to the outside of the walking sole 9; however, this support element 17 may equally well be connected to, or made unitary with, the inner sole 11, 11', or may be free in relation to said sole, as shown in FIGS. 1 to 5. In these types of construction, the inner sole 11, 11' has merely one support area 22 against which the upper surface 23 of the support element 17 is freely pressed. In order to avoid the potential loss of said element when the boot is used for walking, this device advantageously comprises a shoulder 24 whose dimension is greater than that of the guide 17' in the sole 9. On the other hand, in the variants of the transmission devices 13, 13', shown in FIGS. 6, 7, and 8, in which the support element 17 is made unitary with the inner sole 11, 11', it is this sole which immobilizes said support element 17 on the boot.

FIG. 6 illustrates the detail of the adjustment of the guide 17' in relation to the support element 17, notably by the intercalation of a joint 25 designed to facilitate the translational motion of said support device 17, while ensuring the imperviousness of the boot in this area.

In FIGS. 7 and 8, the adjustment of the guide 17' is resolved differently, notably by coupling the shapes of the support element 17 and of its guide 17' in the direction of the pivoting motion of the inner sole 11, 11' around its hinge 14, i.e., concentrically to this latter.

Figure 9:
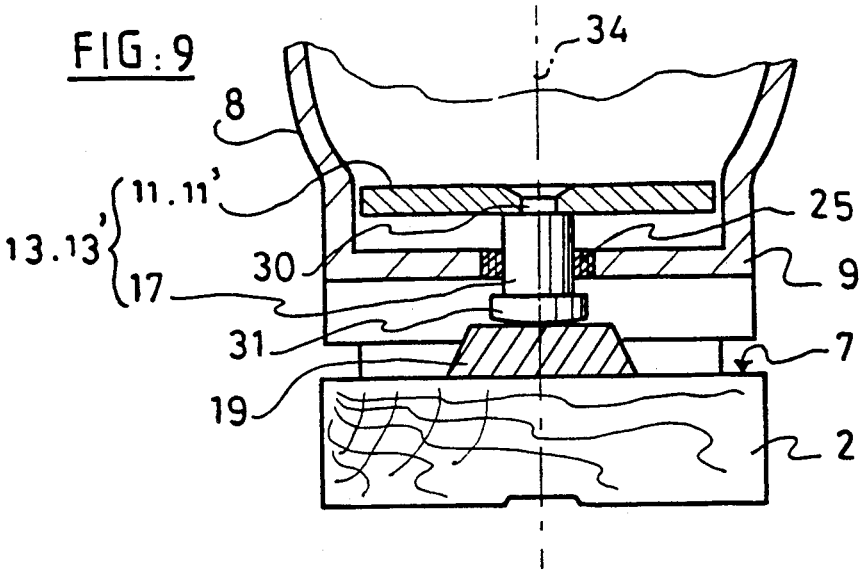
FIGS. 9 to 11 are cross-sections along the line A—A in FIG. 1 illustrating several variants of construction and of cooperation of the device with the top of the ski.
Figure 10:
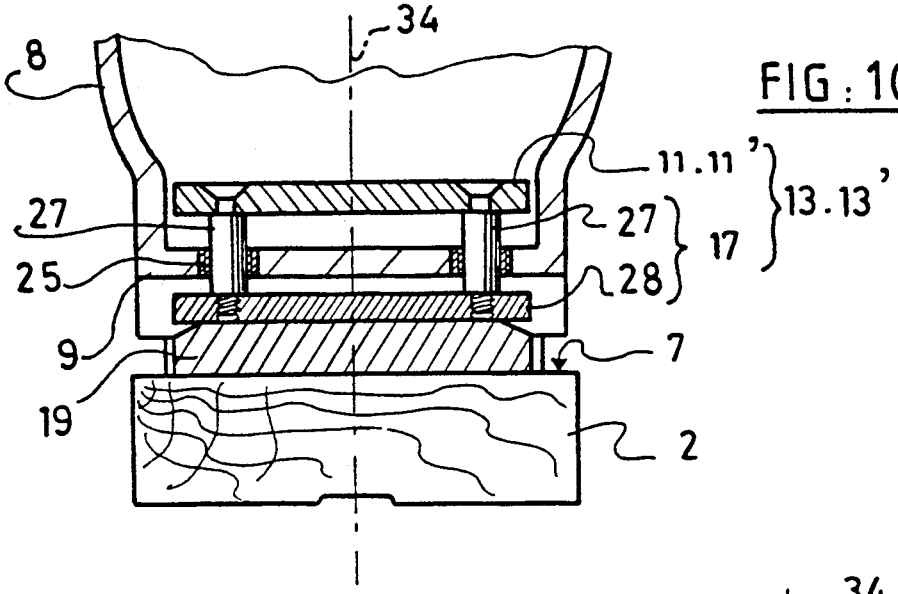
Figure 11:
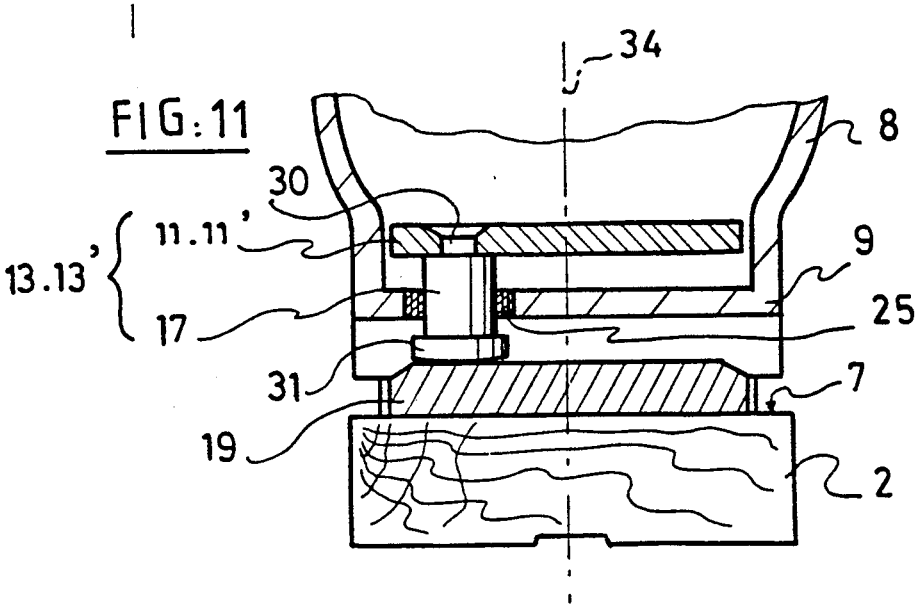

Also according to the invention, the transmission device 13, 13' may be manufactured in various ways depending on the control and/or effects to be produced on the ski. As illustrated in FIGS. 9, 10, and 11 most notably, the area of cooperation of the support element with the top 7 of the ski 2 may be either centralized in one point lying on the median longitudinal axis of the ski 9, or distributed substantially over the entire width of the ski (FIG. 10), or, yet again, localized at any one point along the width of the ski (FIG. 11). In these various construction embodiments, the support element 17 rests for support on the top 7 of the ski 2 by means of a block, as was seen previously with reference to FIG. 1 to 5, but could also have a greater height so as to be set directly on said top 7 of the ski.

In FIG. 9, the support element 17, composed of a shaft with shoulders, of which shaft one end 30 is attached to the inner sole 11, 11' while the other end 31, which is free and constitutes the high stop means, abuts against block 19, is located at a point transverse to the sole of the boot, which point coincides substantially with the longitudinal median axis 34 of the ski 2. This end 31 is advantageously fitted with a curved surface, such as a spherical cap 35, in such a way that the support provided by the block is always effectively achieved, whatever the inclination of the sole 11, 11' around its joint 14, 14'.

As shown in FIG. 10, the support element 17 is composed, first, of two shoulder-equipped shafts 27 set a distance from one another transverse to the sole 9 of the boot, so as to be substantially symmetrical in relation to the median longitudinal axis 34 of the ski when the boot is held in position on the latter, and second, of a small bar 28 connecting said shafts 27, which comes into contact with the block 19 and which, furthermore, constitutes the high stop means of the device.

FIG. 11 shows a support element 17 of the same type as that described in FIG. 9, but mounted so as to be offset from the axis 34 and on one side of the sole 9 of the boot. This construction favors the transmission of internal pressures exerted by the foot to the outside of the boot only on that side of the ski 2 on which the element is supported.

Figure 12:
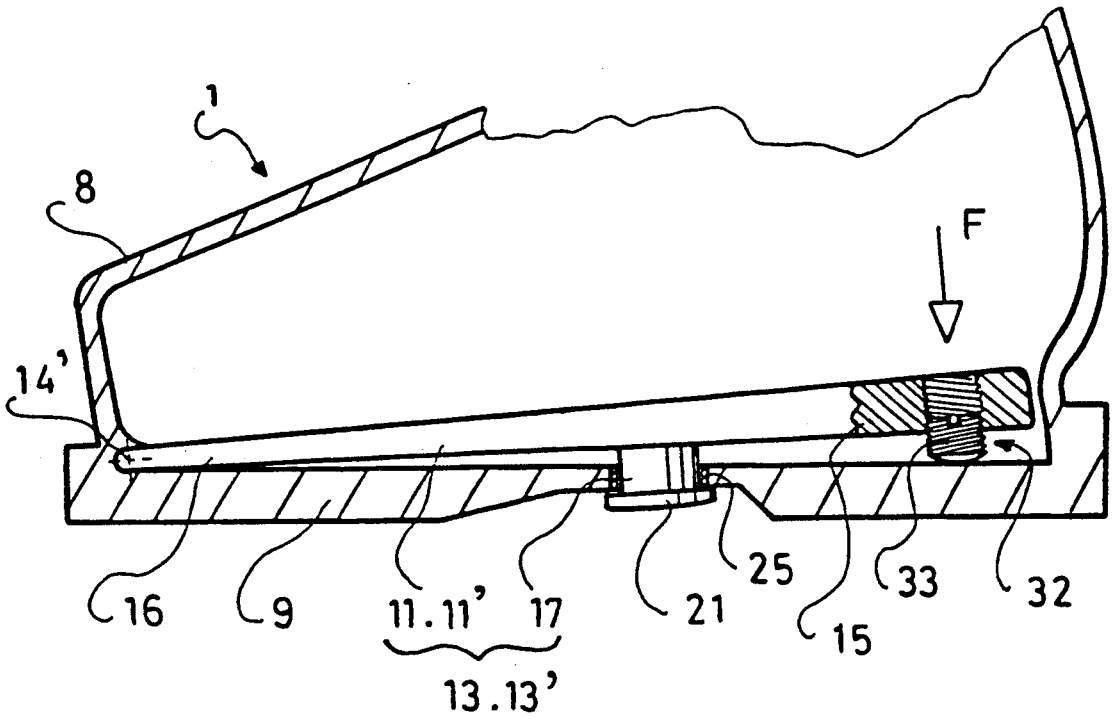
FIGS. 12 and 12*a* show the adaptation of a means of neutralization of the operation of the device according to the invention, FIG. 12*a* illustrating schematically a detail of the inner sole seen from point F in FIG. 12.
Figure 12A:
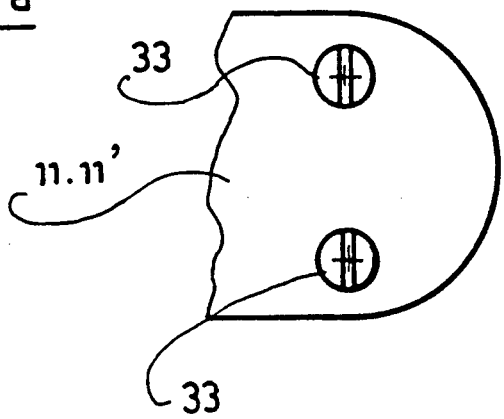

Without departing from the scope of the invention, the transmission device 13, 13' illustrated in FIG. 12 may also be fitted with a neutralization means 32 designed to immobilize the inner sole 11, 11' in a position such that it can no longer undergo a particular degree of angular play around its joint 14' In this embodiment, the support element 17, which is provided with a stop means 21, is made unitary with the inner sole 11, 11', and the neutralization means 32 is constituted by two screws 33 (FIG. 12*a*) mounted in the end 15 of said inner sole, which rests on the bottom of the shell base. Accordingly, by screwing them in to a specified extent, the end 15 of the inner sole 11, 11' is raised, and the stop means 21 of the support element 17 is simultaneously raised against the sole 9 until it immobilizes the transmission device 13, 13' in the high position. It is evident that these same screws 33 may also constitute the means for adjusting the seating position of the foot in the boot and/or of the available amplitude of play of the inner sole, and thus, of the upward motion of the transmission device 13, 13'.

The adjustment of the position of the transmission device 13, 13' relative to the top 7 of the ski 2 may also be made by means of a block 19 whose thickness is adjustable.

Finally, the high stop means 21, 31 of the transmission device may also be born by the inner sole 11, 11' without departing from the scope of the invention.

What is claimed is:

1. Alpine ski boot comprising:

(a) a shell base (8) fitted with a walking sole (9) and surmounted by a shaft (10);

(b) a rigid inner sole (11, 11') movable vertically in relation to a bottom (12) of said shell base (8);

(c) a device (13, 13') for transmission of pressures exerted by a foot from an interior to an exterior of said boot (1) onto a top (7) of a ski (2), said device comprising said inner sole (11, (11') hinged by only one of two ends (15, 16) of said inner sole to said bottom (12) of said shell base (8), and a support element (17) movable in substantially vertical translational motion and mounted at an approximate mid-point of a length of said walking sole (9), said support element cooperating with a bottom of said inner sole (11, 11') and extending from said inner sole to said exterior of said boot, through an opening (17') in said bottom of said shell base, in order to cooperate with a support area located on said top (7) of said ski (2).

2. Alpine ski boot according to claim 1, wherein said support element (17) is unitary with said inner sole (11, 11').

3. Alpine ski boot according to claim 1, wherein said support element (17) comprises a means of adjustment (21) of its height.

4. Alpine ski boot according to claim 1, wherein said inner sole (11, 11') comprises a means of adjustment (33) of its support position against said bottom of said shell base.

5. Alpine ski boot according to claim 1, wherein said support device comprises a stop means (21, 28, 31) limiting its translational motion toward said foot.

6. Alpine ski boot according to claim 5, wherein said stop means (21) is placed on said support element (17) at a predetermined height corresponding to optimum clamping of said foot within said boot.

7. Alpine ski boot according to claim 1, wherein said inner sole (11, 11') comprises a stop means (21) limiting the amplitude of its motion around its hinged end (14) toward said foot.

8. Alpine ski boot according to claim 5, wherein a position of said stop means (21, 28, 31) is adjustable with a position of said support element (17) of said inner sole (11, 11') and of said shell base (8) which carries it.

9. Alpine ski boot according to claim 1, wherein said support element (17) is guided in translational motion in said walking sole (9) of said boot through at least one collar joint (24).

10. Alpine ski boot according to claim 1, wherein said support element (17) and a guide thereof (17') across said walking sole (9) of said boot have paired shapes which are concentric to a hinge (14) of said inner sole (11, 11').

11. Alpine ski boot according to claim 1, wherein said support element (17) is located transversely to said sole (9) of said boot, so as to coincide substantially with a median longitudinal axis (34) of said ski (2).

12. Alpine ski boot according to claim 1, wherein said support element (17) is located transversely to a longitudinal axis of said boot, on one side of said walking sole (9), and provides support on a corresponding side of said ski (2).

13. Alpine ski boot according to claim 1, wherein said inner sole (11, 11') comprises a means (32) for neutralizing vertical mobility of said inner sole.

14. Alpine ski boot according to claim 1, wherein said support element (17) is recessed from a plane (20) of a surface of said walking sole (9).

15. Alpine ski boot according to claim 1, wherein said support element (17), which cooperates with said top of said ski, has a curved surface (35).

16. Alpine ski boot according to claim 1, wherein said boot cooperates with a ski (2) provided with a support block (19) in a zone of said ski opposite said support element (17).

17. Alpine ski boot according to claim 16, wherein the he of said support block (19) is adjustable.

* * * * *

UNITED STATES PATENT AND TRADEMARK OFFICE

CERTIFICATE OF CORRECTION

PATENT NO. : 5,005,301

DATED : April 9, 1991

INVENTOR(S) : Mabboux

It is certified that error appears in the above-identified patent and that said Letters Patent is hereby corrected as shown below:

Column 8, line 2;

Claim 17, change "he" to --height--

Signed and Sealed this

Twelfth Day of January, 1993

*Attest:*

DOUGLAS B. COMER

*Attesting Officer*

*Acting Commissioner of Patents and Trademarks*